US011062684B2

(12) United States Patent
Wilfer et al.

(10) Patent No.: US 11,062,684 B2
(45) Date of Patent: Jul. 13, 2021

(54) LIGHTED PEDAL BOARD

(71) Applicant: Hans-Peter Wilfer, Heidelberg (DE)

(72) Inventors: Hans-Peter Wilfer, Heidelberg (DE); Roland Schmidt, Heidelberg (DE); Klaus Lackner, Heidelberg (DE)

(73) Assignee: HANS-PETER WILFER, Markneukirchen (DE)

( * ) Notice: Subject to any disclaimer, the term of this patent is extended or adjusted under 35 U.S.C. 154(b) by 0 days.

(21) Appl. No.: 16/577,298

(22) Filed: Sep. 20, 2019

(65) Prior Publication Data

US 2021/0090540 A1 Mar. 25, 2021

(51) Int. Cl.
*G10H 1/34* (2006.01)
*F21V 33/00* (2006.01)

(52) U.S. Cl.
CPC ..... *G10H 1/348* (2013.01); *F21V 33/0056* (2013.01)

(58) Field of Classification Search
CPC ..... G10H 1/348; F21V 33/0056
USPC ..... 84/721
See application file for complete search history.

(56) References Cited

U.S. PATENT DOCUMENTS 2,621,882 A * 12/1952 Fletcher ..... F21V 21/26 248/282.1
3,270,695 A * 9/1966 Ross ..... D05B 29/12 112/240
2004/0250673 A1* 12/2004 Salerno ..... G10H 1/32 84/746
2011/0051437 A1* 3/2011 Ng ..... F21V 23/06 362/427

* cited by examiner

*Primary Examiner* — Jianchun Qin
(74) *Attorney, Agent, or Firm* — Scarinci Hollenbeck, LLC; Libby Babu Varghese

(57) ABSTRACT

A lighted pedal board includes a main body and a rotatable lighted arm that can be positioned between a horizontal, resting position and any other angle above the main body. In one embodiment, the arm is upright over a top face of the main body so that light shines on the top face of the pedal board.

11 Claims, 6 Drawing Sheets

LIGHTED PEDAL BOARD

PRIORITY AND RELATED APPLICATION

This application is related to co-pending, commonly owned U.S. design patent application Ser. No. 29/706,482, entitled "Lighted Pedal Board" also filed on Sep. 20, 2019.

FIELD OF THE INVENTION

The present invention is directed to pedal board, specifically to a pedal board accessory that is integrally attached to the pedal board.

BACKGROUND OF THE INVENTION

Pedal boards are a common staple in any guitarist's setup, especially guitarists who love sound effects. Pedal boards come in different shapes and sizes and serve to hold any type of effect pedal. Most musical performances take place on dark stages. Lights are often used with pedal boards to make it easier to see the face of the pedal board. In the past, guitarist have resorted to using stand-alone lights with the pedal board or detachable lights that can be removably affixed to the pedal board. What is needed is a single-unit pedal board with an attached light that is easily usable and transportable. The light should be able to be disposed in any angle above the pedal board and shine light on the pedal board at any desired angle.

SUMMARY OF THE INVENTION

A lighted pedal board comprises a main body, a connector and a rotatable arm that has a light. The main body has at least one support including an end or a side and a top face for receiving effect pedals. The connector is rotatable and disposed on the main body on the at least one support. The arm holds a light and it can be L-shaped or bendable along a Z-axis. The arm is allowed to rotate between an X-axis and a Y-axis or between a horizontal position and a non-horizontal position. The horizontal position is a resting position and the non-horizontal position is any angle above a horizontal plane of the main body. A spring is used with the connector to hold the arm and release the arm so that the connector can slide between a joint of the arm and a lower end of the arm. When the spring is expanded the arm is static, when the spring is contracted the arm is movable. The light is disposed on an end of the arm such that the light shines on the top face of the main body. In one embodiment, the arm is upright over a top face of the main body so that light shines on the top face of the pedal board.

DETAILED DESCRIPTION OF THE INVENTION

Figure 1:
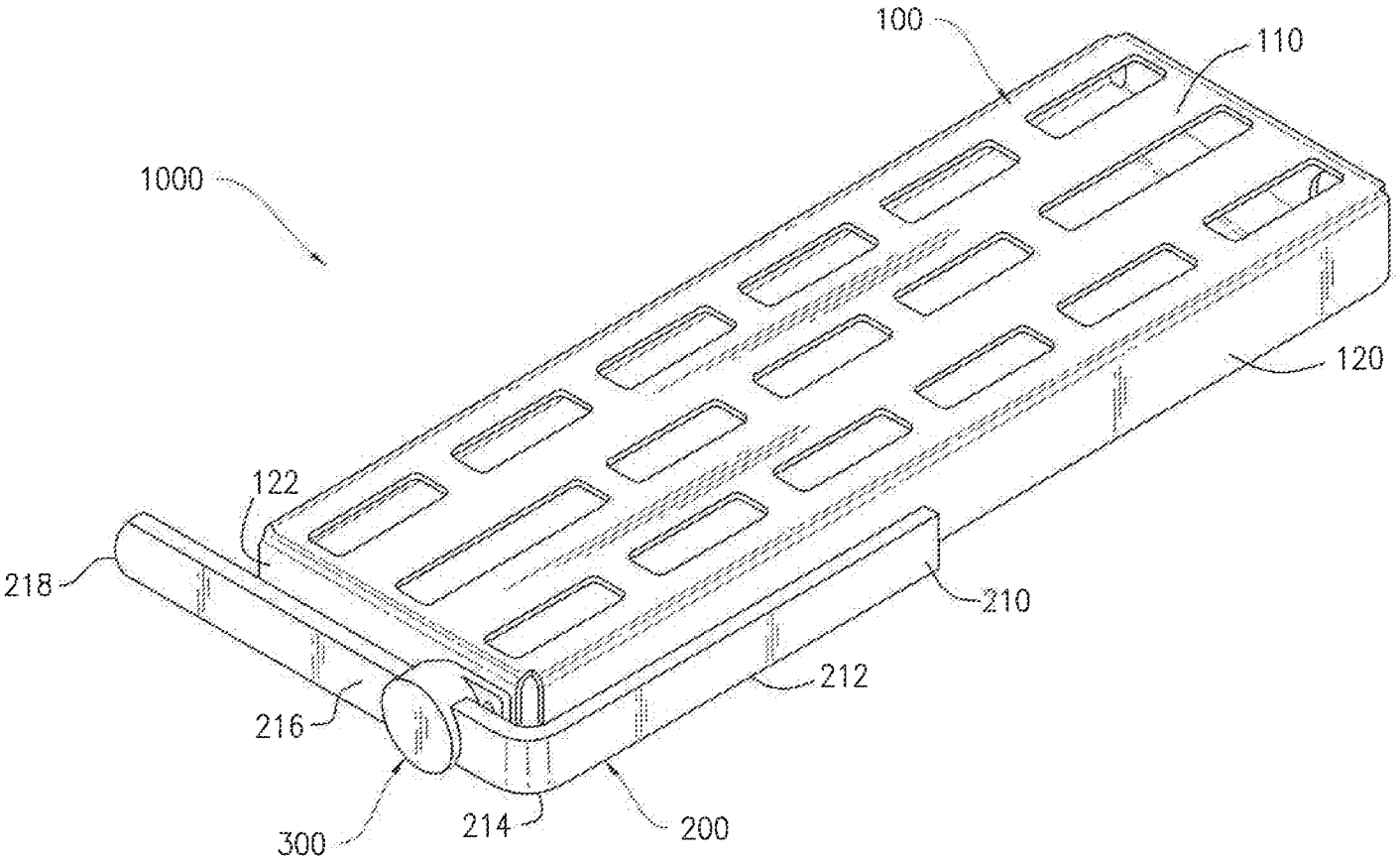
FIG. 1 shows, in a closed position, a lighted pedal board of the present invention.
Figure 2:
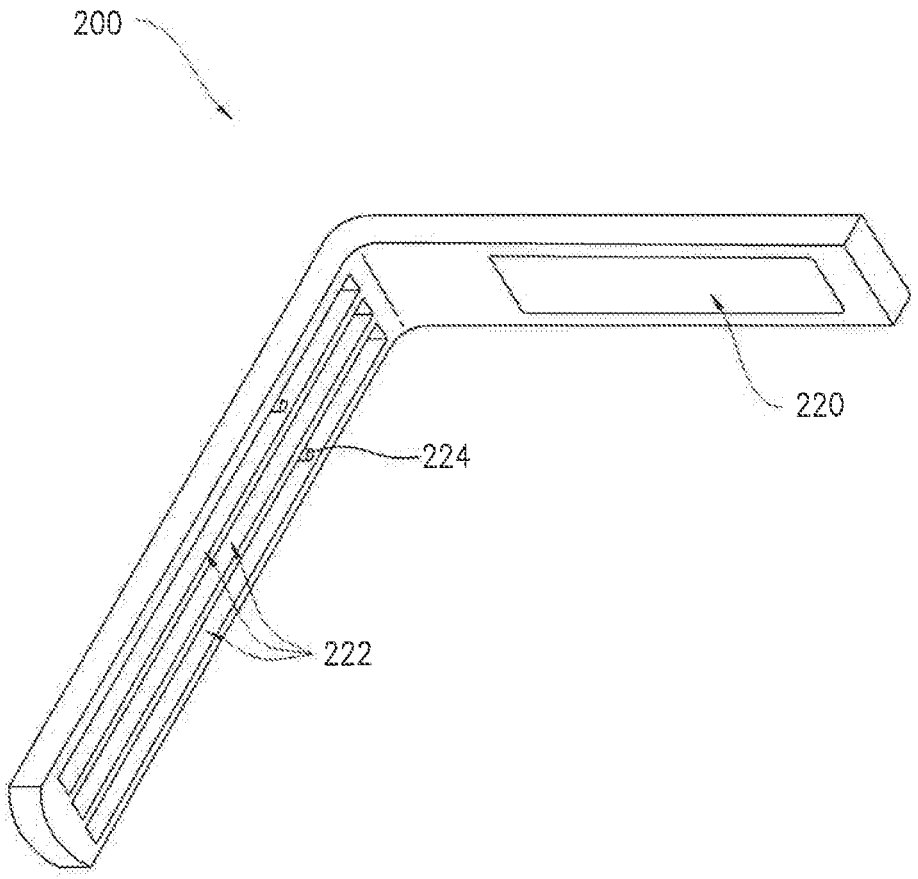
FIG. 2 shows an arm of the lighted pedal board of the present invention.

FIG. 1 shows the pedal board 1000 in a closed, resting position. The pedal board 1000 includes a main body 100 designed to receive effect pedals (not shown), arm 200 and connector 300 connecting the arm 200 to the body 100. The body 100 has a top face 110 and supports 120, 122. Said supports may be ends 120 and sides 122. The arm 200 is L-shaped having a first end 210, a top arm 212, a bottom arm 216 and second end 218. The top arm 212 and bottom arm 216 are joined at junction or bend 214. FIG. 2 shows the arm 200 alone displaying the inner surface which has light 220, protrusions 222 and grooves 224. In another embodiment, the arm 200 may be a generally vertical and bendable so the light 220 can not only be positioned anywhere between an X-axis and Y-axis but also anywhere along a Z-axis so that the light 220 shines on the top face 110.

Figure 3A:
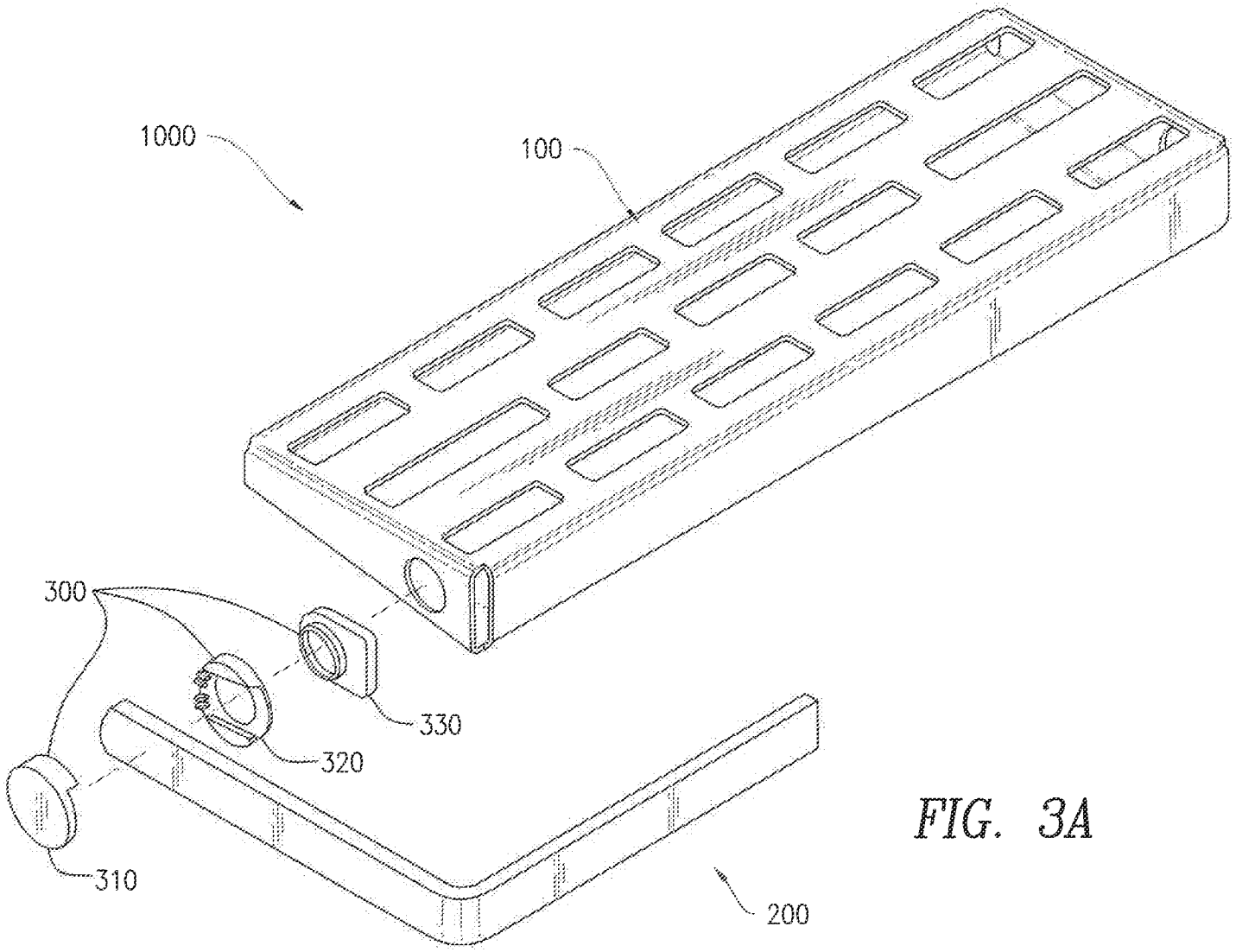
FIG. 3A shows an exploded view of the lighted pedal board of the present invention.
Figure 3B:
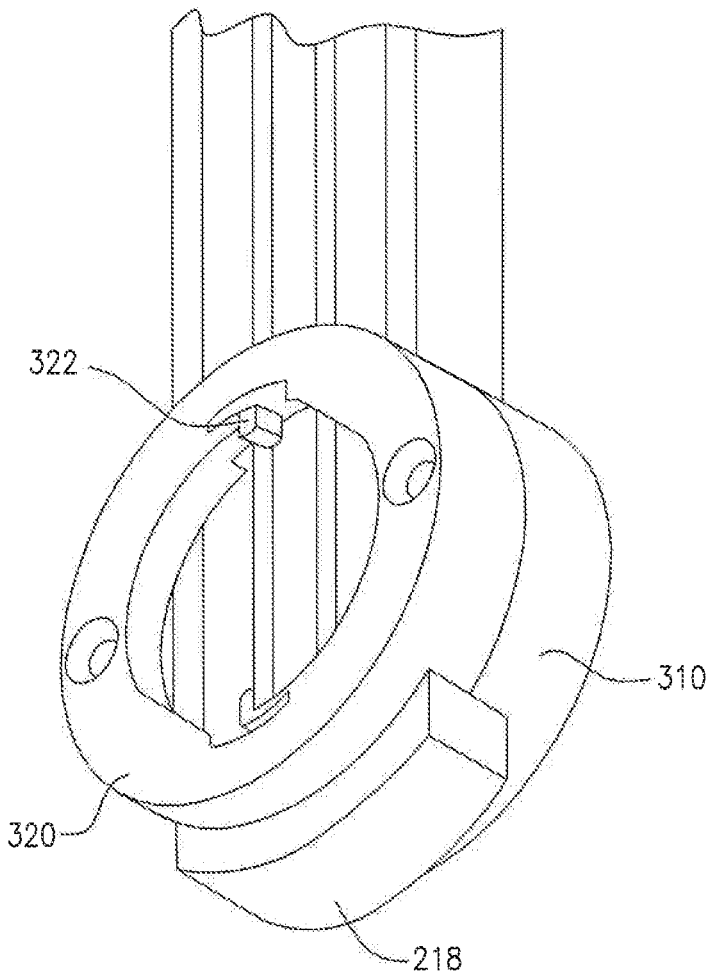
FIG. 3B shows an enlarged view of a lower end of the arm of the lighted pedal board of the present invention with a portion of a connector.

Looking now to FIGS. 3A and 3B, details of the connector 300 are shown. The connector 300 includes a front holding bracket 310, rear holding bracket 320 and flange 330. The front holding bracket 310 and rear holding bracket 320 enclose the arm 200, see FIG. 3B. The rear holding bracket 320 facilitates the assembly of the connector 300 both to grooves 222 in the arm 200 and to flange 330. The flange 330 is affixed to a side 122 of the body 100. In another embodiment, the connector 300 may be disposed on an end 120.

Figure 4:
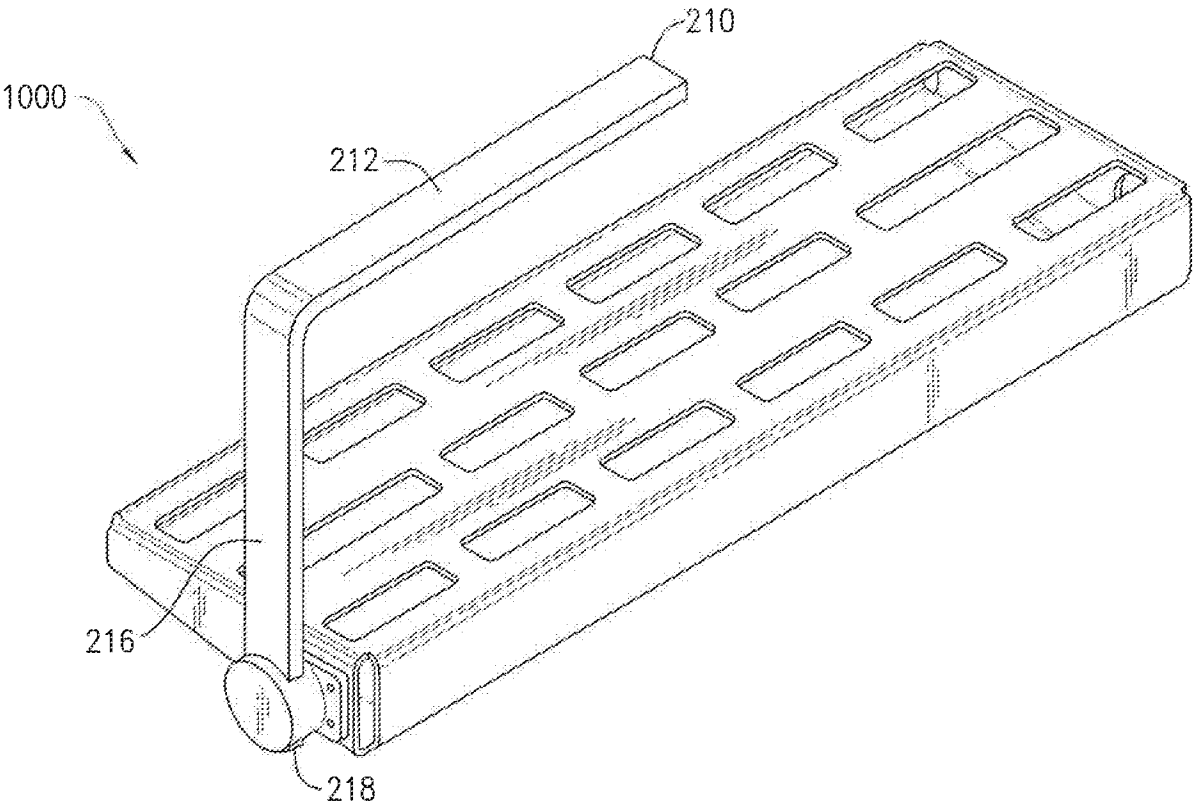
FIG. 4 shows, in an open position, a lighted pedal board of the present invention.

The connector 300 rotates and permits the arm 200 to rotate from a horizontal position, see FIG. 1, to a non-horizontal position. FIG. 4 shows the arm 200 rotated into a vertical position. The connector 300 thus controls the movement of the arm 200. In one embodiment, the rear holding bracket 320 has spring 322 that, when compressed, allow the connector 300 to move along the grooves 222 of bottom arm 216. See FIG. 3B.

Looking at FIG. 1, the arm 200 is retracted and in a closed position so that the connector 300 is disposed adjacent to the joint 214. Here the connector 300 holds the arm 200 in place because the spring 322 is in an expanded state and the arm 200 is static, held in place and prevented from moving. When the spring 322 is compressed to be contracted, the connector 300 allows the arm 200 to move by sliding from a position adjacent joint 214 to any other position between joint 214 and end 218. The protrusions 224 and the spring 322 work together to enable the movement and stopping of the arm 200 as it travels through the connector 300.

Figure 5:
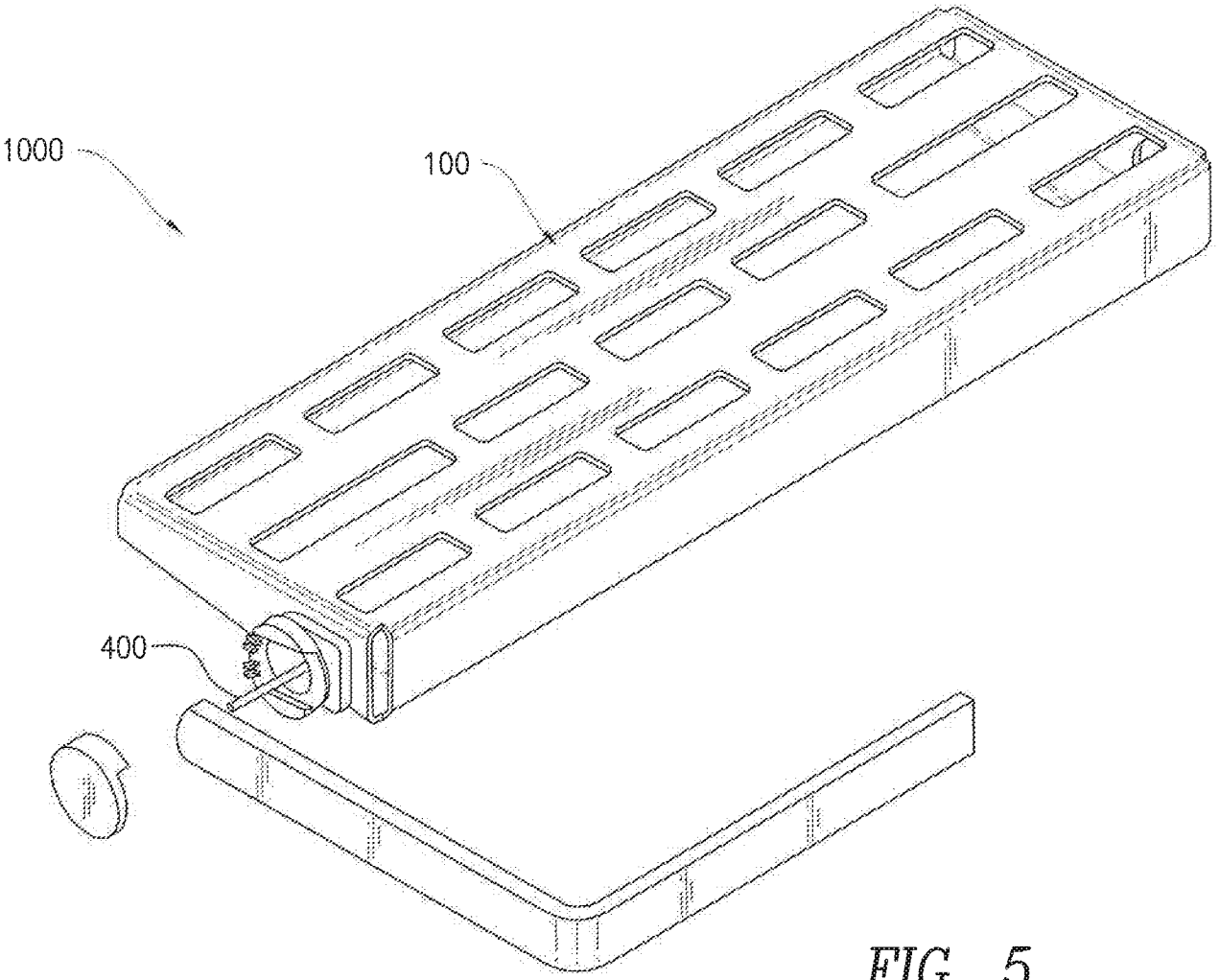
FIG. 5 shows an exploded view of the arm of the lighted pedal board of the present invention showing an electric cable disposed therein.

The connector 300 serves two functions. First, as detailed above, it permits the arm to slide along the length of bottom arm 216. Second, the connector 300 allows the arm 200 to rotate from a horizontal plane to any other angle desired by the user. In one preferred embodiment, the arm 200 is disposed in a vertical position in relation to the body100, see FIG. 4. In this orientation, light 220 shines on the top face 110 of body 100. However, the user can position the arm 200 in any non-horizontal position or plane so light shines on the top face 110. In one embodiment, the light 220 is powered by electrical cable 400 that is wired through the connector 300. See FIG. 5. In another embodiment, the light 220 may activated with batteries or be a detachable light mechanism.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention. For instance, other configurations of the body 100, arm 200 and connector 300 may be envisioned for use in the present invention.

We claim:

1. A pedal board comprising:

a main body having a top face for receiving effect pedals;

a rotatable connector disposed on the main body;

an arm disposed within the connector, the arm having a first end , a second end and a joint, said joint disposed between said first end and said second end, the arm is slidably engaged to the connector, the arm capable of sliding in the connector between the joint of the arm and the second end of the arm, wherein the arm is rotatable about the main body from a closed position to any other angle; and a light disposed on the arm.

2. The pedal board of claim 1, wherein said arm rotates between a horizontal position and a non-horizontal position.

3. The pedal board of claim 1, wherein the connector employs a spring to hold the arm, when the spring is expanded the arm is static, when the spring is contracted the arm is movable.

4. The pedal board of claim 1, wherein the arm is L-shaped.

5. The pedal board of claim 1, wherein the arm is bendable.

6. The pedal board of claim 1, wherein the light is disposed on an end of the arm such that the light shines on the top face of the main body.

7. The pedal board of claim 1, wherein the main body has at least one support.

8. The pedal board of claim 7, wherein the support is either a side or an end.

9. The pedal board of claim 7, wherein the connector is disposed on the support.

10. The pedal board of claim 7, wherein said support downwardly depends from the top face of the main body.

11. The pedal board of claim 1, wherein said connector comprising a front holding bracket and a rear holding bracket, wherein said front holding bracket and said rear holding bracket slidably engages said arm.

* * * * *